US011828258B2

(12) United States Patent
Eastwood et al.

(10) Patent No.: US 11,828,258 B2
(45) Date of Patent: Nov. 28, 2023

(54) INJECTOR APPARATUS

(71) Applicant: RKLAB AG, Root (CH)

(72) Inventors: Daniel Eastwood, Shoreham-by-Sea (GB); Riccardo Meldolesi, Shoreham-by-Sea (GB); Martin Selway, Shoreham-by-Sea (GB); John Lutwyche, Shoreham-by-Sea (GB)

(73) Assignee: RKLAB AG, Root (CH)

( * ) Notice: Subject to any disclaimer, the term of this patent is extended or adjusted under 35 U.S.C. 154(b) by 0 days.

(21) Appl. No.: 17/783,291

(22) PCT Filed: Dec. 9, 2020

(86) PCT No.: PCT/EP2020/085352
§ 371 (c)(1),
(2) Date: Jun. 8, 2022

(87) PCT Pub. No.: WO2021/116213
PCT Pub. Date: Jun. 17, 2021

(65) Prior Publication Data

US 2023/0016854 A1 Jan. 19, 2023

(30) Foreign Application Priority Data

Dec. 9, 2019 (GB) ..... 1918005

(51) Int. Cl.
*F02M 59/02* (2006.01)
*F02M 59/46* (2006.01)

(52) U.S. Cl.
CPC ..... *F02M 59/025* (2013.01); *F02M 59/022* (2013.01); *F02M 59/46* (2013.01)

(58) Field of Classification Search
CPC .... F02M 59/105; F02M 59/107; F02M 49/02; F02M 59/366
(Continued)

(56) References Cited

U.S. PATENT DOCUMENTS 2,230,920 A * 2/1941 Wirtsen ..... F02M 49/02 239/87
2,552,776 A * 5/1951 French ..... F02M 59/462 123/495

(Continued)

OTHER PUBLICATIONS

International Search Report and Written Opinion of the International Searching Authority issued in PCT/EP2020/085352, dated Feb. 17, 2021; ISA/EP.

*Primary Examiner* — Sizo B Vilakazi
*Assistant Examiner* — Brian R Kirby
(74) *Attorney, Agent, or Firm* — Harness, Dickey & Pierce, P.L.C.

(57) ABSTRACT

An injector apparatus (310) for injecting fluid under pressure into an associated chamber (332) is provided. The injector apparatus (310) includes a first piston (314) defining a first working area facing an associated chamber (332), a high pressure piston (318) defining a high pressure working area facing a high pressure chamber (319), and a control piston (317) defining a control piston working area facing a control chamber (315). The first piston (314) is moveable with a body of the injector apparatus (310) to compress fluid in the high pressure chamber (319) using the high pressure piston (318), while movement of the first piston (314) is selectively controllable by controlling the fluid in the control chamber (315). The first working area is larger than the control piston working area and the control piston (317) working area is larger than the high pressure working area.

20 Claims, 5 Drawing Sheets

(58) Field of Classification Search
USPC ..... 239/90, 87; 123/497
See application file for complete search history.

(56) References Cited

U.S. PATENT DOCUMENTS 2,572,118 A * 10/1951 Dickson ..... F02M 49/02 239/87
2,703,562 A * 3/1955 Seubert, Jr. ..... F02M 49/02 123/445
2,740,667 A * 4/1956 Hulsing ..... F02M 59/107 239/90
2,799,535 A * 7/1957 French ..... F02M 49/02 239/90
3,055,593 A * 9/1962 May ..... F02M 49/02 239/553.3
3,236,219 A * 2/1966 Bilisco ..... F02M 57/00 123/495
3,898,970 A * 8/1975 Malpass, Sr. ..... F02M 49/02 123/502
4,244,342 A * 1/1981 Fenne ..... F02M 49/02 123/446
4,247,044 A * 1/1981 Smith ..... F02M 59/366 239/585.1
4,306,680 A * 12/1981 Smith ..... F02M 49/02 239/585.1
4,394,856 A * 7/1983 Smith ..... F02M 49/02 123/460
4,427,151 A * 1/1984 Trenne ..... F02M 49/02 239/585.1
4,618,095 A * 10/1986 Spoolstra ..... F02M 59/366 239/93
4,951,631 A * 8/1990 Eckert ..... F02M 59/32 123/446
5,484,104 A * 1/1996 Kukler ..... F02M 49/02 123/496
5,775,305 A * 7/1998 Bolger ..... F02M 49/02 123/497
6,644,281 B2 * 11/2003 Boehland ..... F02M 45/12 239/88
2017/0226976 A1 * 8/2017 Kukler ..... F02M 57/025

* cited by examiner

INJECTOR APPARATUS

CROSS REFERENCE TO RELATED APPLICATIONS

This application is a U.S. National Phase Application under 35 U.S.C. 371 of International Application No. PCT/EP2020/085352, filed on Dec. 9, 2020, which claims priority to British Patent Application No. 1918005.8, filed on Dec. 9, 2019. The entire disclosures of the above applications are expressly incorporated by reference herein.

The present invention relates to an injector apparatus and to internal combustion engines comprising such injector apparatuses.

Although the present invention is described with reference to fuel injectors used in internal combustion engines, it is applicable to any injector apparatus for injecting a fluid under pressure into an associated chamber.

Fuel injectors used in internal combustion engines, including both spark ignition and compression ignition (or diesel) engines, generally utilise an external pump for supplying the fuel under sufficient pressure to be injected into the engine cylinder. The timing of the injection point in the engine operating cycle is determined by external controlling of the operation of an injector valve by a mechanical or electrical means. One disadvantage of providing external pumping and the control is the need for the provision of servicing of such external systems.

According to a first aspect of the present invention, there is provided an injector apparatus for injector fluid under pressure into an associated chamber, the apparatus including: a body, a first piston moveable in the body, the first piston defining a first working area facing an associated chamber, a high pressure piston defining a high pressure working area facing a high pressure chamber, the first working area being greater than the high pressure working area, the first piston being operable to compress fluid in the high pressure chamber using the high pressure piston, and a control piston defining a control piston working area facing a control chamber, wherein movement of the first piston is selectively controllable by controlling the fluid in the control chamber, wherein the first working area is larger than the control pressure working area and the control pressure working area is larger than the high pressure working area.

With this arrangement, the injector apparatus is operable to generate very high injection pressures using the pressure within the combustion chamber without the need for an external high pressure pump. Further, the first piston can be hydraulically locked using fluid in a control chamber which is pressurised by the control piston and can be hydraulically unlocked by venting the control chamber without the need to vent the high pressure chamber. By providing a control piston with a working area which is larger than the high pressure working area and smaller than the first piston working area, the fluid pressure in the control chamber is higher than the pressure in the associated chamber. This means that the amount of fluid that must be vented to initiate injection during each injection cycle can be reduced. This can reduce the time taken to vent the injector prior to injection and can reduce the number and capacity of vent valves required.

The first piston may define at least a part of the high pressure chamber. The high pressure chamber may be defined by the body of the injector. In such embodiments, the first piston may define at least a part of the high pressure piston which faces the high pressure chamber.

The first piston may define a high pressure bore of the high pressure chamber within which the high pressure piston is positioned.

The high pressure piston may be fixed relative to the body.

The high pressure piston may be moveable relative to the body.

The first piston may comprise the control piston. The control piston may be unitary with the first piston. In other embodiments, the control piston may be distinct from the first piston and connected to it by one or more intermediate elements.

The control piston may be annular. The control piston may be cylindrical. The control piston may have any other suitable cross-sectional shape, including but not limited to oval, elliptical, triangular, square, rectangular, pentagonal, hexagonal, or other regular or irregular polygonal shape.

The control piston working area may be annular. The control piston working area may be circular. The control piston working area may have any other suitable shape, including but not limited to oval, elliptical, triangular, square, rectangular, pentagonal, hexagonal, or other regular or irregular polygonal shape.

The control chamber may define a control chamber bore within which the control piston is positioned. The control chamber bore may be fixed relative to the body. In other embodiments, the control piston may be positioned in a further chamber in fluid communication with the control chamber.

The first piston may include an injector orifice through which fluid can be injected into an associated chamber from the high pressure chamber. In other examples, the injector orifice may be provided as part of one or more other components of the injector apparatus. For example, the injector orifice may be provided as part of an injector nozzle forming part of the injector apparatus. The injector nozzle may be connected to the first piston.

The injector apparatus may further include a first valve, or "control chamber vent valve", operable to vent the control chamber to a lower pressure region. Alternatively, or in addition, the injector apparatus may further include a second valve, or "high pressure chamber vent valve", operable to vent the high pressure chamber to a low pressure region.

The lower pressure region may be a tank or reservoir. The lower pressure region may be configured to store fluid to be injected. The lower pressure region may contain fluid to be injected. The lower pressure region may be open to the atmosphere.

The injector apparatus may further include a low pressure chamber at least partially defined by the first piston and a bore of the body and configured to displace fluid to a low pressure region during injection.

The control chamber may be fluidly connected to the low pressure chamber via a first passage in which a control chamber vent valve is located, the control chamber vent valve being operable to vent the control chamber to the low pressure chamber. For example, the control chamber vent valve may be operable to vent the control chamber to the low pressure chamber in order to initiate fluid injection.

The control chamber vent valve may be operable to permit the supply of fluid to the control chamber from the low pressure chamber via the first passage. For example, the control chamber vent valve may be operable to permit the supply of fluid to the control chamber from the low pressure chamber in order to fill the control chamber with fluid prior to injection.

The high pressure chamber may be fluidly connected to the low pressure chamber via a second passage in which a high pressure chamber vent valve is located, the high pressure chamber vent valve being operable to vent the high pressure chamber to the low pressure chamber. For example, the high pressure chamber vent valve may be operable to vent the high pressure chamber to the low pressure chamber in order to stop fluid injection.

The high pressure chamber vent valve may be operable to permit the supply of fluid to the high pressure chamber from the low pressure chamber via the second passage. For example, the high pressure chamber vent valve may be operable to permit the supply of fluid to the high pressure chamber from the low pressure chamber in order to fill the high pressure chamber with fluid prior to injection.

The low pressure chamber may be at least partly defined by an annular bore of the first piston. Where the first piston comprises the control piston, the low pressure chamber may be at least partly defined by an annular bore of the first piston extending around the control piston and located between an outer surface of the control piston and an outer wall of the first piston. The low pressure chamber may be at least partly defined by an annular bore in the body of the injector apparatus. The low pressure chamber may be defined by an annular bore of the first piston and by an annular bore in the body of the injector apparatus which are fluidly connected.

The injector apparatus may further comprise a return valve between the low pressure chamber and the low pressure region, wherein the return valve is operable to fluidly connect the low pressure chamber to the low pressure region. The return valve may be operable to fluidly connect the low pressure chamber to the low pressure region prior to injection in order to vent fluid from the low pressure chamber to the low pressure region prior to injection. The return valve may be operable to fluidly connect the low pressure chamber to the low pressure region during injection in order to vent fluid from the low pressure chamber to the low pressure region during injection.

The injector apparatus may further comprise a pump operable to supply fluid to the low pressure chamber from the low pressure region. The pump may be operable to supply fluid to the low pressure chamber from the low pressure region prior to injection.

The first piston may be freely moveable relative to the body. In such embodiments, the first piston is moved towards and away from the associated chamber during use due to pressure imbalances above and below the first piston. Alternatively, the injector apparatus may further comprise a return spring configured to bias the first piston towards the associated chamber during use. In this manner, it can be possible to supply the injector apparatus with fluid even when the pressure in the combustion chamber is higher than on the opposite side of the first piston. This can provide greater flexibility in the amount and timing of a flow of low pressure fluid into the injector apparatus for cooling during operation.

According to a second aspect of the invention, there is provided a reciprocating internal combustion engine comprising at least one combustion chamber, and at least one injector apparatus according to the first aspect, the at least one injector apparatus being configured to inject fluid under pressure into the at least one combustion chamber.

The invention will now be described, by way of example only, with reference to the accompanying drawings, in which.

Figure 1:
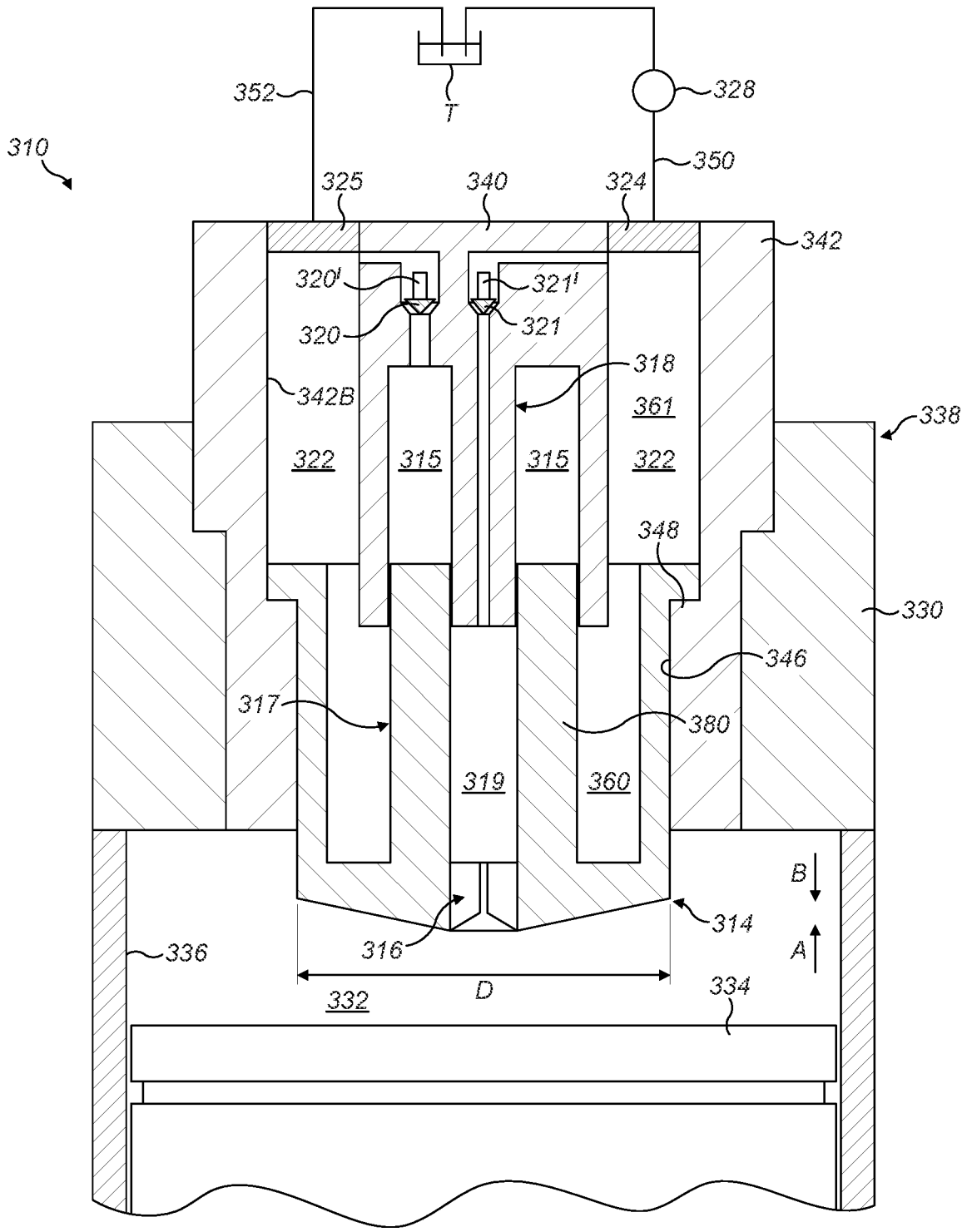
FIG. 1 is a cross-section view of an injector apparatus according to the present invention showing the injector apparatus received in a cylinder head of a reciprocating internal combustion engine.

With reference to FIGS. 1 to 5, there is shown an injector apparatus 310 having a body 312, a first piston 314, an injector nozzle 316, a control piston 317, and a high pressure piston 318.

The injector apparatus further includes a control chamber vent valve 320 and a high pressure chamber vent valve 321.

In use, the injector apparatus is attached to a cylinder head 330 (shown schematically) or the like with the nozzle 316 being configured to inject fluid into an associated chamber 332, such as an internal combustion chamber.

The associated chamber 332 varies in volume as a piston 334 reciprocates within a cylinder 336 of an internal combustion engine 338.

In use, a pump 328 may be connected to a tank T. The tank T may supply fluid to the pump 328 and may also receive fluid from the injector apparatus as will be further described below.

The body 312 has a first part 340 and a second part 342. The second part 342 is secured to the first part 340 (details of which are not shown).

The second part 342 includes a bore 346 having an internal diameter D, in one example D=25 mm. The second part 342 has a shoulder 348.

The first part 340 includes a passage 349 being associated with the control chamber vent valve 320 and a passage 351 associated with the high pressure chamber vent valve 321. First part 340 further includes a fill line 350 (shown schematically) associated with a fill valve 324 and a return line 352 (shown schematically) associated with a return valve 325.

Figure 2:
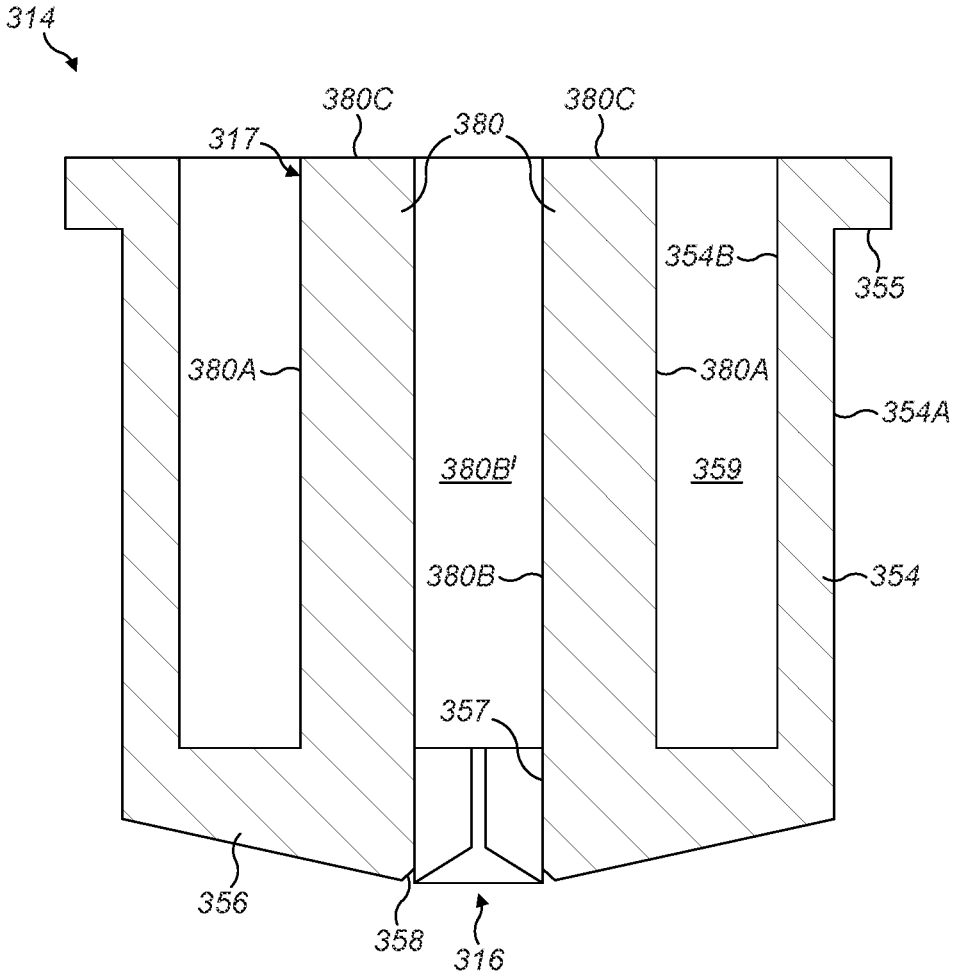
FIG. 2 is an enlarged view of a first piston of the apparatus of FIG. 1.

As best seen in FIG. 2, the first piston 314 has a piston wall 354 sized so that its outer surface 354A is a close sliding fit within bore 346 of the second part 342 so as to essentially seal the wall 354 with the bore 346. The first piston 314 includes a shoulder 355 and an end wall 356 having a bore 357 in which the injector nozzle 316 is secured. The bore 357 has a chamfer 358 at its lower end. The first piston 314 is slidable within the bore 346 and its lowermost position is defined by engagement of shoulder 355 with the shoulder 348 on the body 312.

Unitarily formed with the first piston 314 is a control piston 317. Control piston 317 depends upwardly from end wall 356 of the first piston 314 and has a cylindrical annular stem 380 with an outer surface 380A, an inner surface 380B and an end surface 380C. Inner surface 380B defines a high pressure bore 380B'. End surface 380C defines the control chamber working area, as will be further described below.

Figure 3:
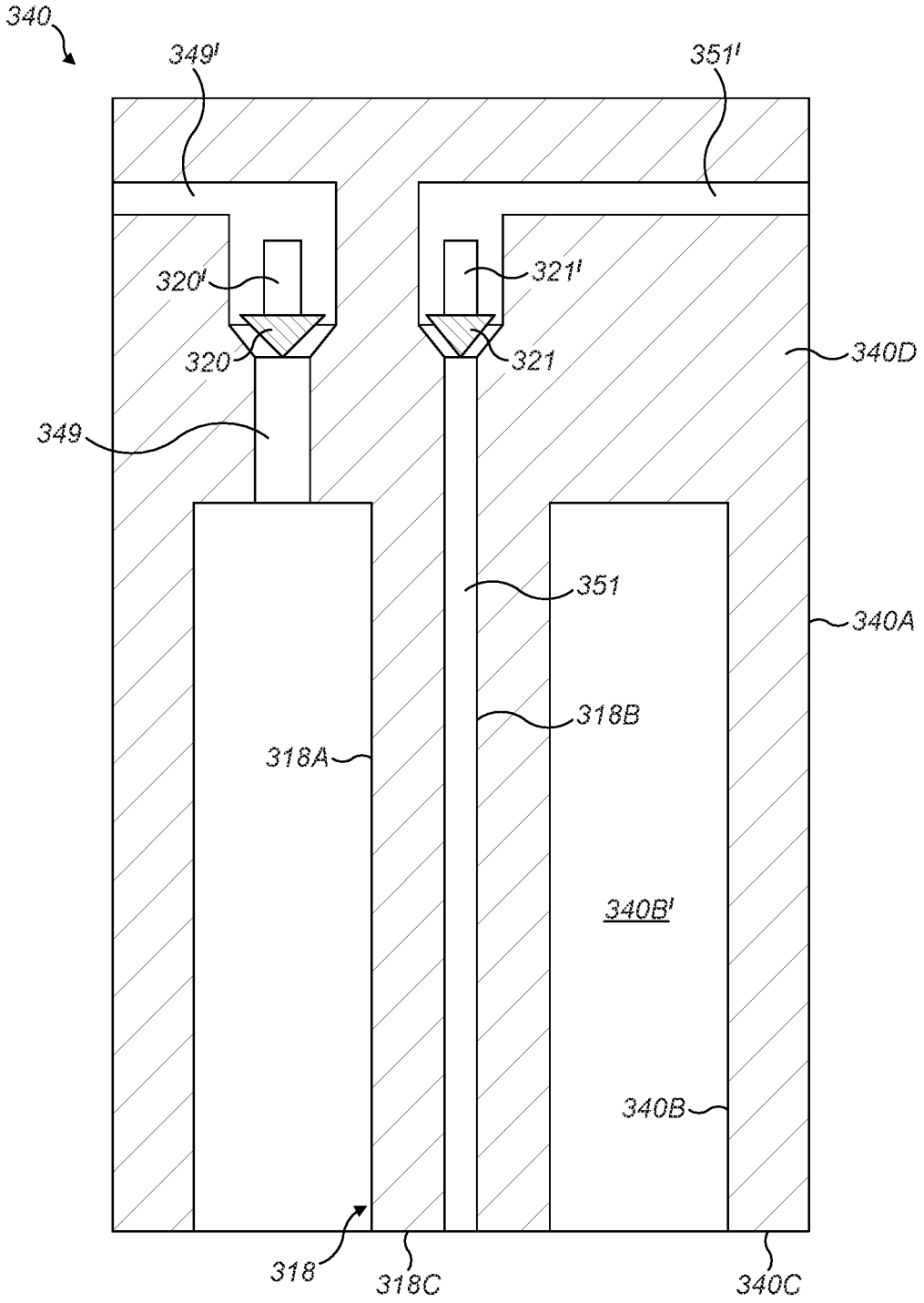
FIG. 3 is an enlarged view of a first part of the body of the injector apparatus of FIG. 1.

As best seen in FIG. 3, the first part 340 of the injector body 312 is generally elongate and includes an outer surface 340A, an inner surface 340B, an end surface 340C, and an upper wall 340D. A high pressure piston 318 depends downwardly from the upper wall 340D into a control chamber bore 340B' defined by the inner surface 340B of the first part 340. The high pressure piston 318 has an outer surface 318A, an inner surface 318B and an end surface 318C. In this manner, the high pressure piston 318 is fixed relative to the body 312. The inner surface 318B defines a central passage 351.

Referring again to FIG. 1, the upper end of the control piston stem 380 extends into the control chamber bore 340B' defined by the inner surface 340B of the first part 340 so that there is a clearance between the end surface 380C of the control piston stem 380 and the upper wall 340D. The lower end of the high pressure piston 318 extends into the upper end of the high pressure bore 380B' defined by the inner surface 380B of the control piston stem 380 so that there is a clearance between the end surface 318C of the high pressure piston 318 and the injector nozzle 316 at the lower end of the high pressure bore 380B'.

The clearance between the end surface 380C of the control piston stem 380 and the upper wall 340D defines a control chamber 315 which is bounded by the inner surface 340B of the first part 340, the outer surface 318A of the high pressure piston 318, the upper wall 340D and the annular end surface 380C of the control piston 317. The clearance between the end surface 318C of the high pressure piston 318 and the injector nozzle 316 defines a high pressure chamber 319 which is bounded by the inner surface 380B of the control piston stem 380, the injector nozzle 316 and the end surface 318C of the high pressure piston 318. In this manner, the first piston 314 defines at least part of the high pressure chamber 319. In particular, the control piston 317, which forms part of the first piston 314, defines the high pressure bore 380B' of the high pressure chamber 319.

The control piston stem 380 is sized so that the outer surface 380A of the stem 380 forms a close sliding fit within the control chamber bore 340B' of the first part 340 so as to essentially seal outer surface 380A with the bore 340B'. The control piston stem 380 is also sized so that the outer surface 318A of the high pressure piston 318 forms a close sliding fit within the high pressure bore 380B' of the control piston stem 380 so as to essentially seal the outer surface 318A with the high pressure bore 380B' defined by the inner surface 380B of the control piston stem 380. The close sliding fit between the stem 380 and the adjacent components allows the control piston 317 to slide axially relative to the first part 340 and the high pressure piston 318 to vary the volumes of the control chamber 315 and the high pressure chamber 319.

The first piston 314 defines an annular region 360 between the inner surface 354B of the piston wall 354 and the outer surface 380A of the stem 380. The first part 340 and second part 342 of the body define an annular region 361 between the outer surface 340A of the first part 340 and an inner surface 342B of the second part 342 which surrounds the first part 340. Region 361 is fluidly connected to region 360. Together region 360 and region 361 form a low pressure chamber 322.

The control chamber 315 is generally cylindrical and annular. At an end of the control chamber 315 opposite control piston 317, is a passage 349 which fluidly connects control chamber 315 to a control chamber vent valve 320. The opposite side of the control chamber vent valve 320 is fluidly connected to the low pressure chamber 322 by a passage 349'. The control chamber vent valve 320 is operated by a solenoid 320'. When the control chamber vent valve 320 is open, the control chamber 315 is connected to the low pressure chamber 322 via passages 349 and 349'. When the control chamber vent valve 320 is closed, passage 349 is isolated from passage 349' and fluid communication between the control chamber 315 and the low pressure chamber 322 is prevented.

The high pressure chamber 319 is generally cylindrical and is connected to a high pressure chamber vent valve 321 via the central passage 351 in the high pressure piston 318. The opposite side of the high pressure chamber vent valve 321 is fluidly connected to the low pressure chamber 322 by a passage 351'. The high pressure chamber vent valve 321 is operated by a solenoid 321'. When the high pressure chamber vent valve 321 is open, the high pressure chamber 319 is connected to the low pressure chamber 322 via passages 351 and 351'. When the high pressure chamber vent valve 321 is closed, passage 351 is isolated from passage 351' and fluid communication between the high pressure chamber 319 and the low pressure chamber 322 is prevented.

The low pressure chamber 322 is generally annular and is fluidly connected to pump 328 (shown schematically) via fill valve 324 and fill line 350, and is fluidly connected to tank T (shown schematically) via return valve 325 and return line 352. When the fill valve 324 is open, the low pressure chamber 322 is in fluid communication with the fill line 350 and fluid can be pumped into the low pressure chamber 322 by the pump 328, provided the output pressure from pump 328 is higher than the pressure in the low pressure chamber 322. When the fill valve 324 is closed, the low pressure chamber 322 is isolated from the fill line 350 and from the pump 328. When the return valve 325 is closed, the low pressure chamber 322 is in fluid communication with the return line 352 and fluid can be vented from the low pressure chamber 322 to the tank T via the return line 352. When the return valve 325 is closed, the low pressure chamber 322 is isolated from the return line 352.

Figure 4:
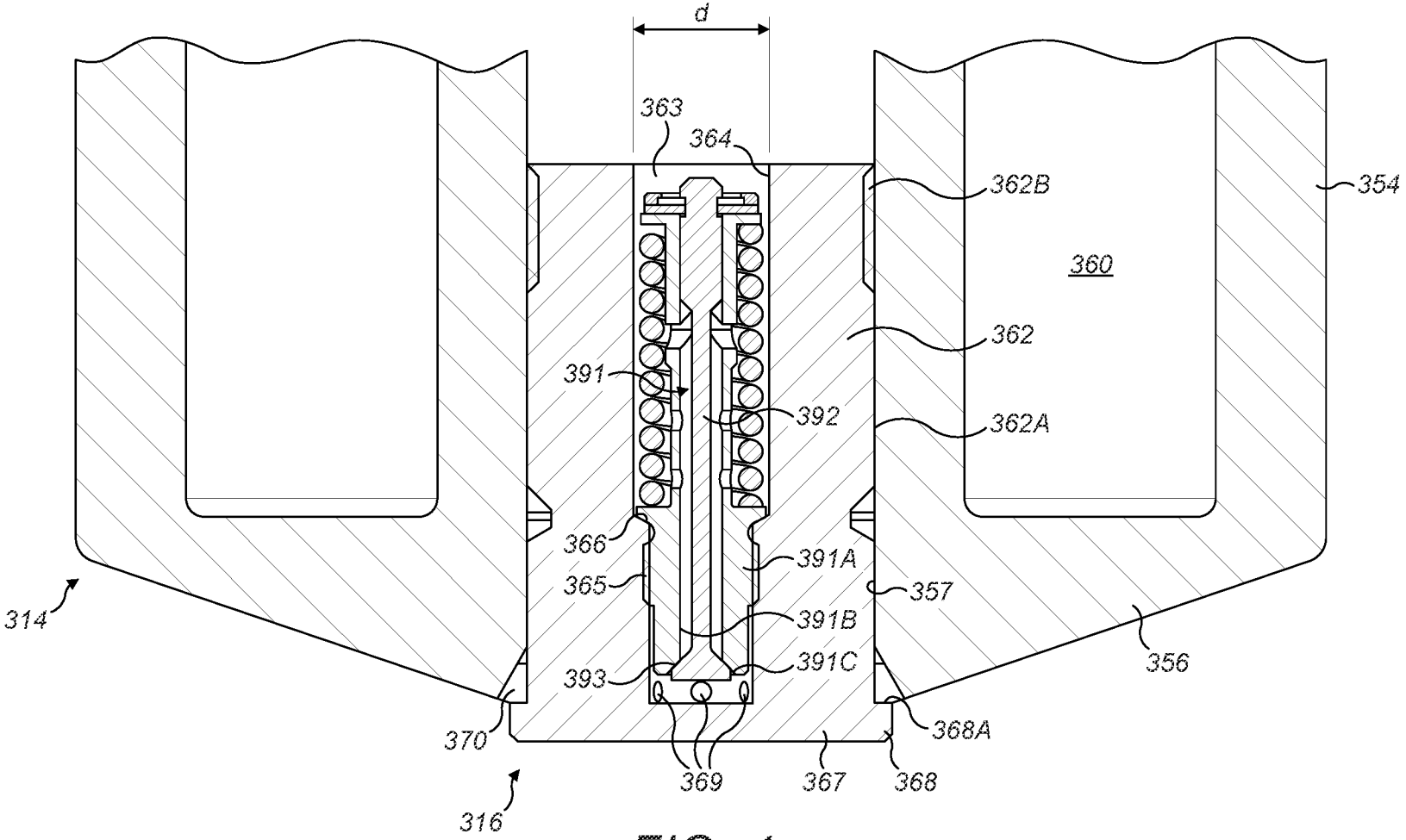
FIG. 4 shows a cross-sectional view of an injector nozzle located in an end wall of the first piston of the injector apparatus of FIG. 1.
Figure 5:
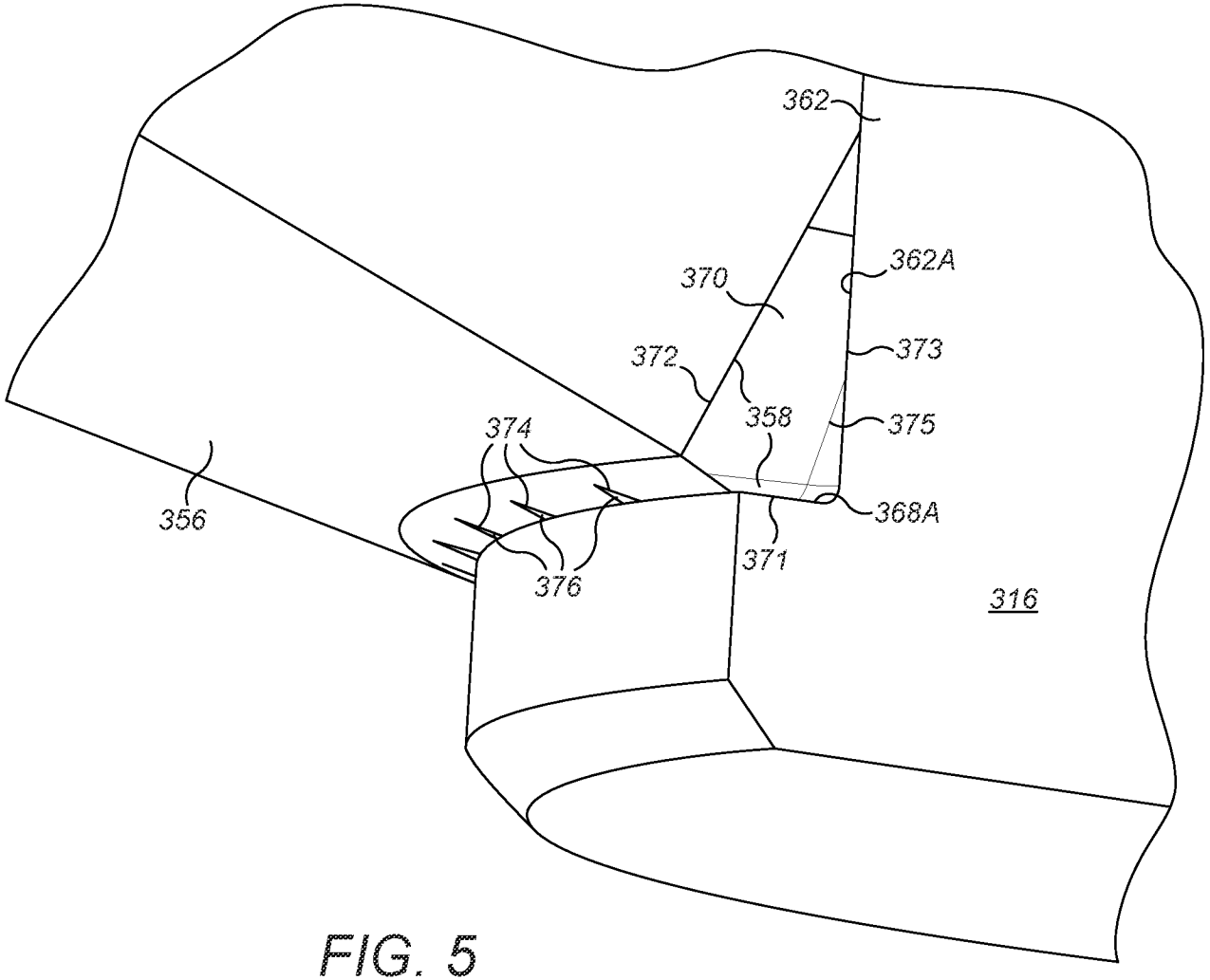
FIG. 5 is a further view of the injector nozzle shown in FIG. 4.

As best seen in FIGS. 4 and 5, the injector nozzle 316 includes a stem 362 having an outer surface 362A, sized to be a close fit or a press fit in the bore 357 in the end surface 356 of the first piston 314. The stem 362 also has an external thread 362B on its outer surface 362A and a bore 363 defined by a bore wall 364, an internal thread 365 and a shoulder 366. In one example the bore 363 has a diameter d of 3.5 mm. The bore 363 in the injector nozzle 316 is smaller than the diameter of the bore 357 in the end surface 356 of the first piston 314. The injector nozzle 316 also includes an end wall 367 having a flange 368. The flange 368 has a flange surface 368A. Cross-drilling 369 fluidly couples the bore 363 to the outer surface 362A of the stem 362 in a region near the flange 368.

Located within the bore 363 of the injector nozzle 316 is a valve 391 which is retained by the internal thread 365. The valve 391 has a valve body 391A which defines a central bore 391B. The upper end of the central bore 391B is open to the bore 363 of the stem 362. The lower end of the central bore 391B defines a valve seat 391C. The valve 391 also includes a moveable valve element 392 inside the central bore 391B which is biased towards the closed position and has a valve surface 393 which selectively engages and disengages with the valve seat 391C to open and close the valve 391.

The injector nozzle 316 further includes an annular nozzle ring 370 having a first surface 371, a second surface 372 and a third surface 373. The first surface includes a series of generally radially orientated grooves 374. In this example, the first surface 371 is flat but it could be at an angle, for example it could be frustoconical. The second surface 372 is frustoconical. The third surface is cylindrical. The nozzle ring 370 also includes a chamfer 375 between the third surface 373 and the first surface 371. When the injector nozzle 316 is assembled into the first piston 314, the nozzle ring 370 is forced into the "wedge" shape defined between the chamfer 375 and the outer surface 362A of the stem 362. In this position, the first surface 371 is sealed against the flange surface 368A, the second surface 372 is sealed against the chamfer 358 and the third surface 373 is sealed against the stem wall 362A. When the first surface 371 of the nozzle ring is in engagement with the flange surface 368A, the grooves 374 define a plurality of injector holes 376.

Operation of the injector apparatus 310 is as follows:—

Prior to injection, for example at the start of the compression stroke of the piston 334, the injector apparatus 310 is in the primed condition. In the primed condition, the control chamber 315, high pressure chamber 319 and low pressure chamber 322 are all primed with fluid supplied from the tank T, via pump 328 and fill line 350. The fluid is at relatively low pressure (e.g. 3-5 bar). The first piston 314 is in its lowermost position (when considering FIG. 1) such that shoulder 355 of the first piston 314 is in engagement with shoulder 348 of the body 312. The valve element 392 is also in its uppermost position such that valve surface 393 is in engagement with valve seat 391C thereby isolating the orifices 376 from the high pressure chamber 319. Control chamber vent valve 320 is closed. High pressure chamber vent valve 321 is closed. Fill valve 324 is closed. Return valve 325 is open.

As the piston 334 ascends within cylinder 336 during the compression stroke of the internal combustion engine 338, pressure is developed within the combustion chamber 332. This increasing pressure ($P_{comb}$) acts on the first working area ($A_{fp}$) of the first piston 314 to generate a force ($F_{fp}$) in the direction of arrow A, which can be expressed as:

$$F_{fp}=P_{comb}\times A_{fp}$$

Where the first piston 314 has a circular working area, as in this example, then $A_{fp}$ is equal to $(\pi/4)D^2$. Thus, as the pressure $P_{comb}$ within the combustion chamber 332 increases, so too does the force $F_{fp}$ on the first piston 314 in the direction of arrow A. However, the first piston does not move in the direction of arrow A, because the upward force on piston 314 is resisted by fluid within the control chamber 315 being hydraulically locked by the fluid in the control chamber 315 (by virtue of control chamber vent valve 320 being closed). This hydraulic locking results in a reaction force ($R_{cp}$) in direction B on the end surface 380C of stem 380 of the control piston 317 from the fluid in the control chamber 315.

The effective area of the control piston 317, or "control piston working area", facing the control chamber 315 is equal to the area of the end surface 380C. Where the end surface 380C of the control piston 317 has a circular annular shape, as in this example, then the control piston working area ($A_{cp}$)) equates to $\pi\times$(outer surface 380A diameter-inner surface 380B diameter)$^2/4$.

In order to start injection, a control system (not shown) causes the control chamber vent valve 320 to open, e.g. by powering the solenoid 320'. This fluidly connects passage 349 to passage 349', and hence fluidly connects the control chamber 315 to the low pressure chamber 322. The return valve 325 may also be opened by the control system to fluidly connect the low pressure chamber 322 to the tank T via the return line 322. With the control chamber vent valve 320 open, fluid in the control chamber 315 vents to the low pressure chamber 322. Thus, the control chamber 315 no longer provides a hydraulic lock. The pressure within the combustion chamber 332 acting on first piston 314 thereby moves first piston 314 upwardly as fluid is vented from the control chamber 315 through the control chamber vent valve 320. Upward movement of the first piston 314, i.e. in the direction of arrow A, causes the volume of the high pressure chamber to decrease, since the injector nozzle 316 ascends with the first piston 314 whereas the high pressure piston 318 remains in place. Thus, the pressure in the high pressure chamber 319 increases. This increases the force exerted on the valve 391 in the direction of arrow B, i.e. downwardly in FIG. 1, by fluid in the high pressure chamber. Once pressure in the high pressure chamber 319 is sufficiently high to overcome the spring force on the valve element 392, the valve surface 393 of valve element 392 is disengaged from the valve seat 391C to open valve 391 and thereby fluidly connect the high pressure chamber 319 with the injector orifices 376. Fuel passes from through cross-drillings 369 and out of the injector orifices 376 into the combustion chamber 332 thereby initiating combustion.

The effective area of the high pressure piston 318, or "high pressure working area" facing the high pressure chamber 319 is equal to the area of the end surface 318C. Where the end surface 318C of the high pressure piston 318 has a circular annular shape, as in this example, and the high pressure vent valve 321 is closed, then the high pressure piston working area ($A_{cp}$) equates to $\pi\times$(outer surface 318A diameter)$^2/4$.

The pressure in the high pressure chamber is defined by the pressure in the combustion chamber 332 and the ratio of the working areas of the first piston 314 and the high pressure piston 318, i.e.:

$$P_{hp}=P_{comb}\times(A_{fp}/A_{hp})$$

As fluid is injected, the first piston 314 progressively moves in the direction of arrow A, i.e. rises when viewing FIG. 1. However, provided fluid pressure in the high pressure chamber 319 remains sufficient to keep the valve 391 open, the injector nozzle 316 can continue to inject fuel as fluid from the control chamber 315 is vented to tank.

As will be appreciated, the effective area of the high pressure piston 318 is significantly smaller than the effective area of the first piston 314 and as such the pressure within the high pressure chamber 319 will be greater than the pressure created in the combustion chamber 332 of the internal combustion engine. This allows extremely high injection pressures to be generated, e.g. above 3000 bar. As will also be appreciated, the effective area of the control piston 317 is smaller than the effective area of the first piston 314 and larger than the effective area of the high pressure piston 318. Consequently, the pressure within the control chamber 315 will be greater than the pressure created in the combustion chamber 332 of the internal combustion engine 338 and will be less than the pressure in the high pressure chamber 319.

In order to stop injection, there are two options:

The first option is to open the high pressure chamber vent valve 321. This causes the high pressure chamber 319 to be vented to the tank T via the low pressure chamber 322 and return line 352. The drop in pressure in the high pressure chamber 319 causes the valve 391 to close thereby preventing further injection. The first piston 314 will continue to move upwardly as the control chamber 315 and high pressure chamber 319 both vent to tank. Upward movement of first piston 314 will stop when the piston wall 354 comes into contact with the top end of region 361.

The second option is to close the control chamber vent valve 320. This isolates passage 349 from passage 349' and hence isolates the control chamber 315 from the low pressure chamber 322 and the tank T. The control chamber 315 is then hydraulically locked. This decelerates upward movement of the first piston 314 and allows the pressure in the high pressure chamber 319 to reduce to close the valve 391 thereby isolating the injector orifices 376 from the high pressure chamber 319 whereupon injection ceases. Note that even though injection has stopped, the high pressure chamber 319 remains pressurised by virtue of the pressure within the combustion chamber 332. Injection typically occurs towards the end of a compression stroke and/or at the start of a combustion (expansion) stroke. Because the high pressure chamber remains pressurised at the end of injection, further injection is possible during the particular compression/combustion stroke by reopening the control chamber vent valve 320. Such "double" injection is referred to as "double strike" injection. As will be appreciated, the present invention allows for two or more distinct injections (i.e. multi-strike injection) to occur during a single compression/combustion stroke.

By hydraulically locking the first piston 314 using fluid in a control chamber 315 which is pressurised by the control piston 317 and has a smaller volume than the low pressure chamber 322, the amount of fluid that must be vented during each injection cycle can be reduced relative to arrangements which require venting of the low pressure chamber.

Once injection for a particular compression/combustion stroke has finally stopped, the pressure within the combustion chamber will fall significantly, typically when an exhaust valve or valves are opened, and consequently the pressure within the high pressure chamber 319 will also fall significantly. The pressure within the combustion chamber 332 will remain at a relatively low pressure during an exhaust stroke and during an inlet stroke. At some time during the time period when the pressure in the combustion chamber is relatively low, the injector apparatus will be re-primed with fuel in time for the next injection event which will occur at the next compression/combustion stroke.

In order to re-fill or re-prime the injector, the return valve 325 is closed and the fill valve 324, control chamber vent valve 320, and high pressure chamber vent valve 321 are all opened when the pressure in the combustion chamber $P_{comb}$ is less than the supply pressure from the pump 328. For example, at or towards the end of the expansion stroke. The pump 328 provides pressurised fluid (e.g. at around 3-5 bar) which flows along fill line 350 into the low pressure chamber 322 to fill the control chamber 315, high pressure chamber 319 and low pressure chamber 322 and push the first piston 314 to the start position in which the shoulder 355 of the first piston abuts the shoulder 348 on the body 312.

Although the control piston 317 is illustrated as being unitary with the first piston 314, this need not necessarily be the case. Instead, the control piston 317 could be positioned elsewhere in the injector apparatus. For example, the control piston could be fixed to the first part 340 of the injector body 312 and moveable within a bore defined in the first piston. Alternatively, the control piston and control chamber could be offset from the central axis of the injector. Similarly, although the high pressure piston 319 is illustrated as being unitary with the first part 340, this need not necessarily be the case. Instead, the high pressure piston 319 could be positioned elsewhere in the injector apparatus. For example, the high pressure piston could be fixed to and moveable with the first piston 314 within a bore defined in the first part 340. Alternatively, the high pressure piston and high pressure chamber could be offset from the central axis of the injector and connected to the injector nozzle by one or more passages.

Although a single high pressure piston and a single control piston are illustrated, the injector apparatus may comprise two or more high pressure pistons and/or two or more control pistons.

Further, although the high pressure chamber and the control chamber are illustrated as being re-primed via the low pressure chamber, one or both of the high pressure chamber and control chamber may be in fluid communication with the feed line via one or more passages which bypass the low pressure chamber.

Although the return line and feed line are schematically illustrated as separate lines, in practice, they may be provided as a single line.

The invention claimed is:

1. An injector apparatus for injecting fluid under pressure into an associated chamber, the apparatus including:

a body;

a first piston moveable in the body, the first piston defining a first working area facing the associated chamber;

a high pressure piston defining a high pressure working area facing a high pressure chamber, the first working area being greater than the high pressure working area, the first piston being operable to compress fluid in the high pressure chamber using the high pressure piston;

a control piston defining a control piston working area facing a control chamber;

a low pressure chamber at least partially defined by an annular bore of the first piston and a bore of the body; and a control chamber vent valve operable to vent the control chamber to the low pressure chamber;

wherein movement of the first piston is selectively controllable by venting the fluid in the control chamber to the low pressure chamber with the control chamber vent valve;

wherein the first working area is larger than the control piston working area and the control piston working area is larger than the high pressure working area.

2. The injector apparatus as defined in claim 1 wherein the first piston defines at least a part of the high pressure chamber.

3. The injector apparatus as defined in claim 2 wherein the first piston defines a high pressure bore of the high pressure chamber within which the high pressure piston is positioned.

4. The injector apparatus as defined in claim 1, wherein the high pressure piston is fixed relative to the body.

5. The injector apparatus as defined in claim 1, wherein the high pressure piston is moveable relative to the body.

6. The injector apparatus as defined in claim 1, wherein the first piston defines the control piston.

7. The injector apparatus as defined in claim 1, wherein the control piston is annular.

8. The injector apparatus as defined claim 1, wherein the control piston working area is annular.

9. The injector apparatus as defined in claim 1, wherein the control chamber defines a control chamber bore within which the control piston is positioned, the control chamber bore being fixed relative to the body.

10. The injector apparatus as defined in claim 1, wherein the first piston includes an injector orifice through which fluid can be injected into the associated chamber from the high pressure chamber.

11. The injector apparatus as defined in claim 1, further including a high pressure chamber vent valve operable to vent the high pressure chamber to a low pressure region.

12. The injector apparatus as defined in claim 1, wherein the low pressure chamber is configured to displace fluid to a low pressure region during injection.

13. The injector apparatus as defined in claim 1, wherein the control chamber is fluidly connected to the low pressure chamber via a first passage in which the control chamber vent valve is located, the control chamber vent valve being operable to vent the control chamber to the low pressure chamber via the first passage.

14. The injector apparatus as defined in claim 13, wherein the control chamber vent valve is operable to permit the supply of fluid to the control chamber from the low pressure chamber via the first passage.

15. The injector apparatus as defined in claim 11, wherein the high pressure chamber is fluidly connected to the low pressure chamber via a second passage in which the high pressure chamber vent valve is located, the high pressure chamber vent valve being operable to vent the high pressure chamber to the low pressure chamber via the second passage.

16. The injector apparatus as defined in claim 15, wherein the high pressure chamber vent valve is operable to permit the supply of fluid to the high pressure chamber from the low pressure chamber via the second passage.

17. The injector apparatus as defined in claim 12, further comprising a return valve between the low pressure chamber and the low pressure region, wherein the return valve is operable to fluidly connect the low pressure chamber to the low pressure region.

18. The injector apparatus as defined in claim 12, further comprising a pump operable to supply fluid to the low pressure chamber from the low pressure region.

19. The injector apparatus as defined in claim 1, further comprising a return spring configured to bias the first piston towards the associated chamber during use.

20. A reciprocating internal combustion engine comprising at least one combustion chamber, and at least one injector apparatus according to claim 1, the at least one injector apparatus being configured to inject fluid under pressure into the at least one combustion chamber.

* * * * *